US005772094A

United States Patent [19]

Kaiser et al.

[11] Patent Number: 5,772,094

[45] Date of Patent: Jun. 30, 1998

[54] CUTTING BLADE

[75] Inventors: Ian R. Kaiser, La Canada; Michael C. Kaiser; Sean A. Neiberger, both of Malibu, all of Calif.

[73] Assignee: Allen-Reed Company, Inc., Los Angeles, Calif.

[21] Appl. No.: 547,527

[22] Filed: Oct. 24, 1995

[51] Int. Cl.[6] ..... B26F 3/02

[52] U.S. Cl. ..... 225/91; 775/39

[58] Field of Search ..... 225/6, 39, 56, 225/77, 91, 21, 43, 48, 49, 50, 58

[56] References Cited

U.S. PATENT DOCUMENTS

| | | | |
|---|---|---|---|
| D. 347,345 | 5/1994 | Kaiser et al. | D6/518 |
| 1,915,736 | 6/1933 | Hurlbut . | |
| 2,305,592 | 12/1942 | Anderson | 164/84.5 |
| 2,766,877 | 10/1956 | Burbank | 206/58 |
| 2,771,185 | 11/1956 | Annen | 206/58 |
| 2,771,186 | 11/1956 | Burbank | 206/58 |
| 2,820,281 | 1/1958 | Amsen | 29/78 |
| 2,888,180 | 5/1959 | Kinker, Jr. | 225/39 |
| 3,034,690 | 5/1962 | Klun | 225/19 |
| 3,070,273 | 12/1962 | Warp | 225/58 |
| 3,137,424 | 6/1964 | Finn et al. | 225/48 |
| 3,144,970 | 8/1964 | Beschmann | 225/39 |
| 3,197,102 | 7/1965 | Bates et al. | 225/58 |
| 3,227,340 | 1/1966 | Haley | 225/19 |
| 3,281,036 | 10/1966 | Woodling | 225/49 |
| 3,549,066 | 12/1970 | Wankow | 225/25 |
| 3,567,087 | 3/1971 | Schramm | 225/43 |
| 3,688,625 | 9/1972 | Thomas et al. | 83/614 |
| 3,810,567 | 5/1974 | Malcolm | 225/67 |
| 3,851,809 | 12/1974 | McKibbin | 225/20 |
| 3,974,947 | 8/1976 | Budny | 225/25 |
| 3,989,175 | 11/1976 | Cherrin | 225/76 |
| 4,005,809 | 2/1977 | Finn | 225/49 |
| 4,059,210 | 11/1977 | Deering, Jr. | 225/47 |
| 4,119,251 | 10/1978 | Golner et al. | 225/20 |
| 4,156,382 | 5/1979 | Baker | 93/33 H |

(List continued on next page.)

OTHER PUBLICATIONS

Ken–Cut Safety Dispenser (undated) Available on sale at least as early as 23 Nov. 1992.

Reynolds Clik–Cut Dispenser (undated) Available on sale at least as early as 23 Nov. 1992.

"Exhibit A", Color Copies of a Photograph of a Blade set forth in Exhibit C Publication Date Unknown.

"Exhibit B", Color Copies of a Photograph of a Blade set forth in Exhibit D Publication Date Unknown.

"Exhibit C", Letter from Armin C. Frank of Metal Edge International, Inc. to Mr. Michael Kaiser of AllenReed Company, Dec. 8, 1995.

"Exhibit D", Letter from Armin C. Frank of Metal Edge International, Inc. to Mr. Michael Kaiser of AllenReed Company, Jan. 17, 1996.

*Primary Examiner*—Rinaldi I. Rada
*Assistant Examiner*—Boyer Ashley
*Attorney, Agent, or Firm*—D'Alessandro & Ritchie

[57] ABSTRACT

A cutting blade is formed from a rectangular sheet of a rigid material such as metal or plastic. One side of the sheet is formed into a roll or tube giving structural rigidity to the entire cutting blade. The remainder of the sheet extends flat and tangentially from the tube. In cross section, the cutting blade looks generally like the arabic numeral "9". At the top ("rounded head portion") of the "9", a series of holes in one or more rows are punched through the cutting blade so that petals of metal project up and out of the "9" shape at its top. Preferably, for each hole, associated petals are pointed in different directions to provide both a cutting edge and a holding edge for film cut with the blade. The cutting blade may include a series of tangs pointing up (toward the top of the "9") which allow the blade to be easily placed over an edge of the dispenser, but not easily removed therefrom. The blade may be placed on a flat, unfolded insert (of cardboard or a similar stiff material) for a conventional cardboard roll dispenser carton, the insert then inserted between the opening flap and a front edge of the carton, and the head of the "9" shaped blade used as a latch to hold the dispenser cover closed. The petals of the holes may be surrounded with protective bumps to further avoid any possibility of scratching a user of the dispenser.

8 Claims, 4 Drawing Sheets

U.S. PATENT DOCUMENTS

| | | | |
|---|---|---|---|
| 4,170,914 | 10/1979 | Carrier | 83/580 |
| 4,196,647 | 4/1980 | Fish | 83/175 |
| 4,197,774 | 4/1980 | Singh et al. | 83/374 |
| 4,210,043 | 7/1980 | Urion et al. | 83/175 |
| 4,245,536 | 1/1981 | Urion | 83/821 |
| 4,325,176 | 4/1982 | Urion et al. | 29/450 |
| 4,340,162 | 7/1982 | Heiman et al. | 225/48 |
| 4,346,829 | 8/1982 | Myers | 225/48 |
| 4,346,830 | 8/1982 | Hauser | 225/91 X |
| 4,358,328 | 11/1982 | Pearson | 225/91 X |
| 4,417,495 | 11/1983 | Gordon et al. | 83/175 |
| 4,426,029 | 1/1984 | Kamp | 225/91 X |
| 4,450,996 | 5/1984 | Kamp | 225/43 |
| 4,646,956 | 3/1987 | Ruff et al. | 225/77 |
| 4,648,536 | 3/1987 | VanderLugt | 225/43 |
| 4,651,911 | 3/1987 | Kirkup et al. | 225/20 |
| 4,666,072 | 5/1987 | McCarter | 225/25 |
| 4,679,718 | 7/1987 | Kai et al. | 225/91 X |
| 4,754,674 | 7/1988 | Perlman | 83/422 |
| 4,762,042 | 8/1988 | Denter et al. | 83/374 |
| 4,787,284 | 11/1988 | Chen | 83/614 |
| 4,951,858 | 8/1990 | Krall | 225/19 |
| 4,957,023 | 9/1990 | Chen | 83/372 |
| 4,960,022 | 10/1990 | Chuang | 83/175 |
| 4,967,628 | 11/1990 | Judd et al. | 83/455 |
| 5,025,692 | 6/1991 | Reynolds | 83/468 |
| 5,036,740 | 8/1991 | Tsai | 83/455 |
| 5,044,241 | 9/1991 | Labrecque | 83/489 |
| 5,292,046 | 3/1994 | Kaiser et al. | 225/19 |

CUTTING BLADE

BACKGROUND OF THE INVENTION

1. Field of the Invention

The present invention relates to cutting blades for cutting sheets of material. More particularly, this invention relates to a novel and unique cutting blade for use with a roll film dispenser.

2. The Prior Art

Dispenser cartons for sheet material are, of course, very well known to the prior art. One very wide spread use for such dispenser cartons is in the dispensing and marketing of food wrap type sheet material. Typical of such food wrap sheet materials are polymeric films which include, for example, polyethylene film, and films produced from copolymers of vinylidine chloride and vinyl chloride (PVC films). Wax paper and aluminum foil are also common food wrap materials available in roll form and suitable for use with the type of dispensers discussed herein. This sheet material is commonly used for protecting food stuffs and the like in restaurants, hotels, and the like. Typically, food wrap sheet material is sold in roll form. In the consumer market, the roll is generally positioned in a disposable dispenser carton that is sealed during distribution of the product from manufacturer to user. Such disposable dispensers are typified by that shown and described in U.S. Pat. No. 2,888,180 to Kinker, Jr. Commercial users often obtain more durable dispensers and purchase rolls of film which fit into the reusable dispensers. Such durable dispensers are typified by that shown and described in U.S. Pat. No. 5,292,046 to Kaiser et al. Dispensers, whether for the commercial market or for the consumer market also incorporate a tearing or cutting blade in their structure. In use, and as a user withdraws a desired length of sheet material from the dispenser, the sheet is generally positioned to overlie the dispenser's cutting blade. The sheet is then torn from one edge of the sheet to the other through use of that cutting blade from the continuous length left on the roll.

It is very well known in the prior art to incorporate a cutting or tearing blade structure with a roll dispenser carton. Perhaps the most widely used structure to date from a commercial standpoint makes use of a separate metal blade having a serrated edge along one edge of that blade from one end to the other. The serrated blade is permanently attached to a paperboard dispenser carton at, for example, a longitudinal corner of the carton. The blade is positioned parallel to the roll's axis so that the serrated edge extends slightly above the corner. This permits the carton's user to easily tear a length of sheet material along the serrated edge at the desired length after drawing it off the roll from within the carton. See, e.g., U.S. Pat. No. 4,651,911 to Kirkup et al. However, this metal serrated blade has a significant disadvantage from a commercial use standpoint particularly in connection with polymeric films.

It is often the case that, after a desired length of polymeric film has been torn from a roll by the carton's cutting blade, the leading edge section of the film sheet that remains on the roll tends to retract into the carton. Accordingly, when it becomes necessary to withdraw additional film from the roll by tearing a subsequent desired length therefrom, it is necessary to open the carton, locate the leading edge of the film on the roll, and thereafter separate the leading edge from that roll. This procedure is particularly troublesome when the dispenser carton holds polymeric films comprised of a copolymer of vinylidine chloride and vinyl chloride. Upon retraction into the carton, the leading or free edge of this type film's rolled up sheet tend to cling to the supply roll remaining in the carton, thereby making the location of that leading edge, as well as the separation thereof from the supply roll, relatively difficult when a subsequent sheet length is desired.

A typical prior art disclosure of a roll dispenser carton for polymeric film, where the carton incorporates a metal serrated cutting edge at one corner of the carton, is illustrated in U.S. Pat. No. 3,144,970 to Beschmann.

In recent years, there have been attempts to develop roll dispensers for the marketplace that incorporate structures by which the film sheet return problem is solved. Some of these dispenser carton structures have been particularly directed to polymeric films. Each of these carton structures incorporates, of course, a tearing or cutting edge at one corner of the carton. One such type of carton structure, for example, incorporates a tacky substance coated onto one wall of the carton in proximity to the carton's cutting blade. The function of this tacky substance is to cause the leading edge of the film sheet remaining on the roll to adhere to the carton's wall adjacent the cutting blade after a desired length has been torn from the roll. This, of course, makes the free edge of the film sheet left on the roll easily accessible to the user when it is subsequently desired to withdraw another length of sheet material from the roll. Typical of prior art carton structures which incorporate a tacky coating are those illustrated in U.S. Pat. Nos. 3,549,066 to Wankow and 3,974,947 to Budny.

Another solution to this problem involves a dispenser which incorporates a hard plastic sheet deployed along the path from the roll of film to the blade. The negative charge of the hard plastic sheet will tend to cling to the positively charged poly vinyl chloride material. A system such as this is taught in U.S. Pat. No. 5,292,046 to Kaiser et al.

Serrated metal blades, also sometimes referred to in the art as "hacksaw blades" pose a serious safety concern. For small cartons as used in the consumer market, the safety concern is somewhat attenuated, although it is possible to cut ones hand or finger on the dispenser blade. For commercial users who employ large and heavy rolls of film, the problem is much more serious as such dispensers are often placed on shelves above the work surface. When the film is pulled, if the dispenser is inadequately secured, the dispenser may move toward the user, fall off of the shelf, blade first, and cause injury.

A new cutting structure capable of overcoming these difficulties and adaptable to both the disposable dispenser market and the durable dispenser market is taught in U.S. Pat. No. 4,340,162 to Heiman et al. and U.S. Pat. No. 4,346,829 to Myers. As taught by Heiman et al. and Myers, these dispensers utilize a cutting structure formed of a U-shaped piece of metal having holes pierced through the apex of the U. The sides of the holes form petals which project upward and either inward or outward from the penetration hole. The petals then present a sharp tearing surface for the film, yet are not long enough to cause serious harm to someone accidentally brushing against the blade or having the dispenser fall, blade first, upon him or her. The petals also solve the film sheet return problem for PVC films by presenting petals angled toward and away from the source of the sheet of film, those angled away acting to hold the sheet after cutting.

While fit for their intended purposes, the cutting blades of the 4,340,162 and 4,346,829 patents may be improved upon by increasing their stiffness as well as by providing an improved attachment structure which obviates the need for a U-shaped blade.

SUMMARY OF THE INVENTION

A cutting blade is formed from a rectangular sheet of a rigid material such as metal or plastic. In the case of plastic, injection processes may be used. One side of the sheet is formed into a roll or tube giving structural rigidity to the entire cutting blade. The remainder of the sheet extends flat and tangentially from the tube. In cross section, the cutting blade looks generally like the arabic numeral "9". At the top ("rounded head portion") of the "9", a series of holes in one or more rows are punched through the cutting blade so that petals of metal project up and out of the "9" shape at its top. Preferably, for each hole, associated petals are pointed in different directions to provide both a cutting edge and a holding edge for film cut with the blade. According to another aspect of the invention, the cutting blade includes a series of tangs pointing up (toward the top of the "9") which allow the blade to be easily placed over a cardboard edge, but not easily removed therefrom. According to yet another aspect of the invention, the blade may be placed on a flat, unfolded insert (of cardboard or a similar stiff material) for a conventional cardboard roll dispenser carton, the insert then inserted between the opening flap and a front edge of the carton, and the head of the "9" shaped blade used as a latch to hold the dispenser cover closed. According to yet another aspect of the present invention, the petals of the holes may be surrounded with protective bumps to further avoid any possibility of scratching a user of the dispenser.

OBJECTS AND ADVANTAGES OF THE INVENTION

Accordingly, it is an object of the present invention to provide an improved blade for use with a film dispenser.

It is a further object of the present invention to provide a blade for use with a film dispenser which may be attached to a surface at a single plane of contact.

A further object of the present invention to provide a blade for use with a film dispenser which is stiffer than prior art U-shaped blades while retaining the safety and sheet retention features of the prior art U-shaped blades.

A further object of the present invention is to provide a blade for use with a film dispenser which in cross section looks generally like the arabic numeral "9".

A further object of the present invention is to provide a "9"-shaped blade for use with a film dispenser which includes a series of tangs pointing up (toward the top of the "9") which allow the blade to be easily placed over a cardboard edge, but not easily removed therefrom.

A further object of the present invention is to provide a "9"-shaped blade for use with a film dispenser which may be placed on a flat, unfolded cardboard insert for a conventional cardboard roll dispenser carton, the insert then inserted between the opening flap and a front edge of the carton, and the head of the "9" shaped blade used as a latch to hold the dispenser cover closed.

Yet a further object of the present invention is to provide a "9"-shaped or "U"-shaped blade for use with a film dispenser including holes with outward directed petals at the Apex of the "U" or at the top of the "9" in which the petals of the holes are surrounded with protective bumps.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

Figure 4:
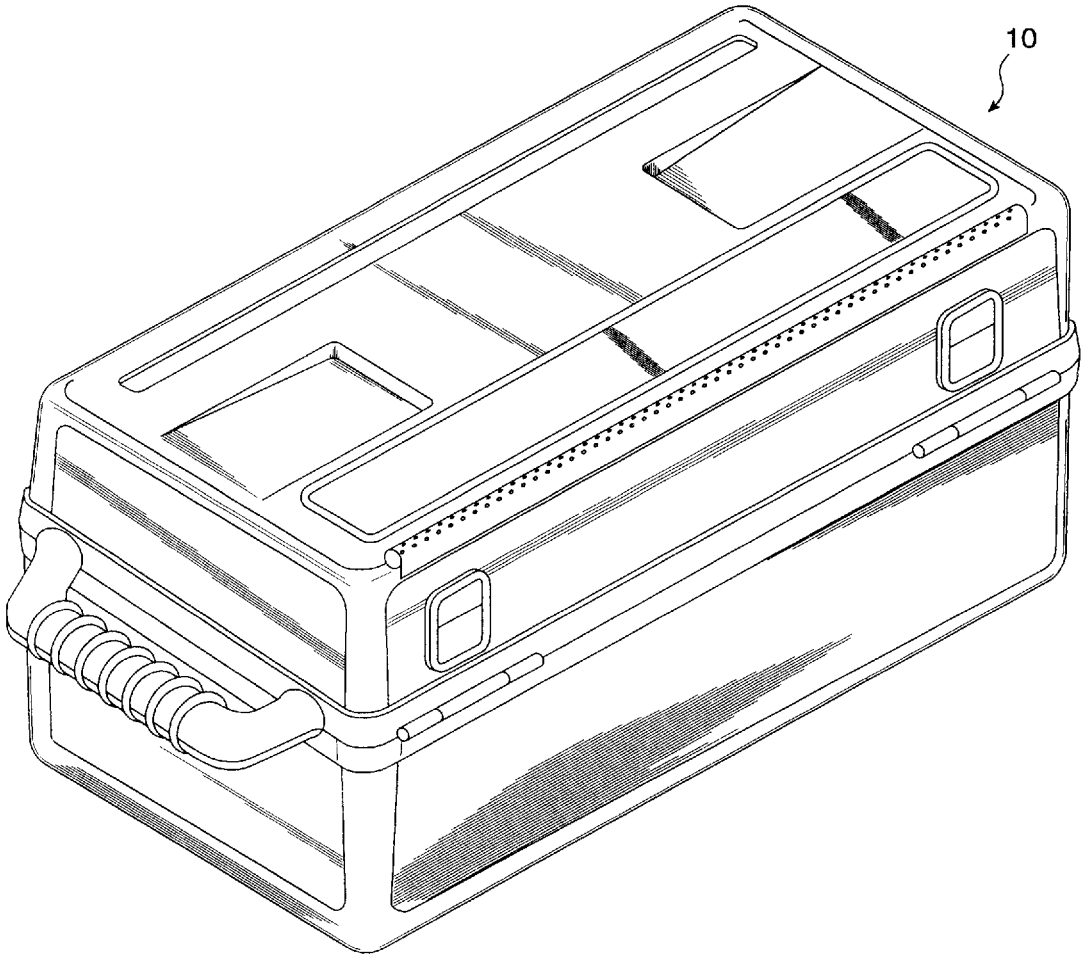
FIG. 4 is a perspective drawing of the cutting blade of the present invention installed in a durable or reusable roll film dispenser.
Figure 5:
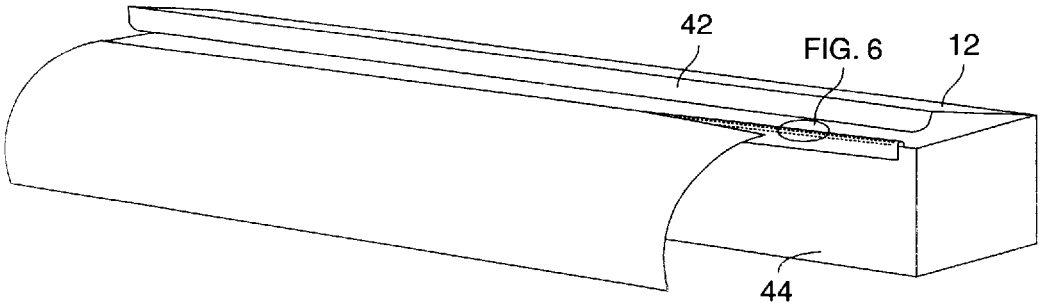
FIG. 5 is a perspective view of the cutting blade of the present invention installed in a conventional cardboard disposable roll film dispenser.
Figure 6:
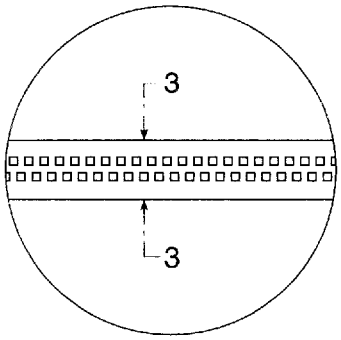
FIG. 6 is an enlargement of the indicated portion of FIG. 5.

Turning now to the drawings, the cutting blade of the present invention may be used with either a reusable film dispenser 10 as depicted in FIG. 4 (more complete construction details are set forth in U.S. Pat. No. 5,292,046 and D-347,345 to Kaiser et al., both of which are hereby incorporated herein by reference as if set forth fully herein) or with a conventional disposable cardboard box 12 as depicted in FIG. 5 (more complete construction details are set forth in U.S. Pat. Nos. 2,888,180 to Kinker, Jr., 3,137,424 to Finn et al., 3,281,036 to Woodling, 4,340,162 to Heiman et al., 4,346,829 to Myers, all of which are hereby incorporated herein by reference as if set forth fully herein).

Figure 1:
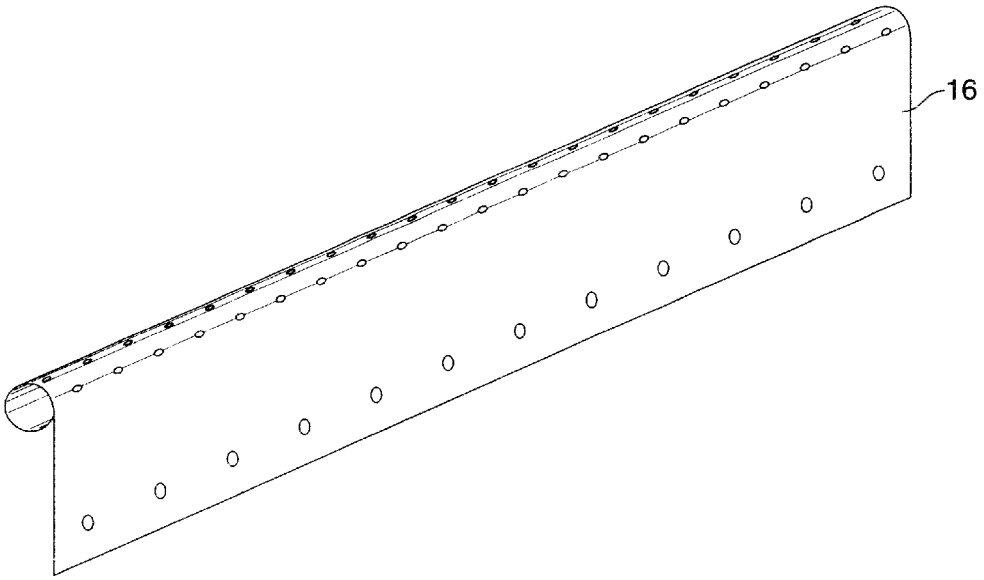
FIG. 1 is a perspective drawing of a cutting blade according to a presently preferred embodiment of the present invention.

A cutting blade 16 in accordance with a first presently preferred embodiment comprises a rectangular sheet of metal bent into the shape of a "9" as shown in FIG. 1. In accordance with a preferred embodiment of the present invention, a plurality of holes or "buds" are disposed through the head 18 of the "9"-shaped cutting blade 16. The buds may be formed in any of a number of conventional ways, but are presently preferred to be punched with a square cross-sectioned implement so as to generate four distinct petals 20 to each bud. The number of petals may be selected by selecting the punch tool. Round, triangle and other shaped holes may be achieved in this manner with more or less well defined petals. It is the petals which provide the cutting action for the sheet material. A single row of buds has been found optimal for cutting aluminum foil. A double row of buds, 50% offset with one another has been found optimal for cutting PVC-type films. The angle between the petals and the bud axis (perpendicular to the surface of the blade and coaxial with the bud hole) is determined by the shape and degree of penetration of the die used to stamp the buds and, hence, form the petals. This is well known to those of ordinary skill in the art of die stamping metal.

In the embodiment shown in FIG. 4, the cutting blade of the present invention is simply attached to a rectangular carrier which may be formed of cardboard, plastic, metal, or another stiff, relatively long-lived material. The carrier with the blade attached is then substituted for the blade of the reusable dispenser (see, e.g., U.S. Pat. Nos. 5,292,046 and D-347,345 to Kaiser et al. for the precise design of the insert).

Figure 2:
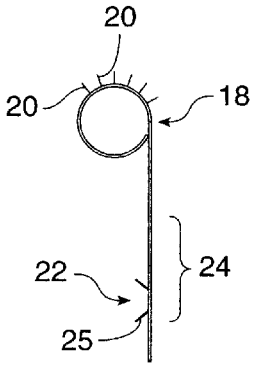
FIG. 2 is an end view/cross sectional of the cutting blade of FIG. 1.
Figure 3:
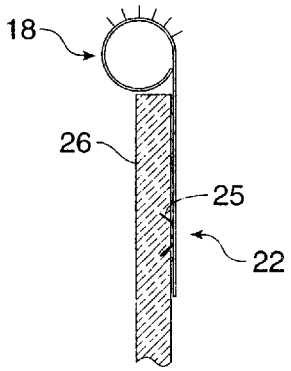
FIG. 3 is a cross sectional view of the cutting blade of FIG. 1 taken along lines 3—3 of FIG. 6.

Turning now to the embodiment depicted in FIG., 5, one method of attaching the "9"-shaped cutting blade to a cardboard dispenser carton or to a cardboard insert is by means of conventional "starburst" fasteners 22 as shown in FIGS. 2 and 3. These fasteners are die cut out of the body of the tail end 24 of the blade in a "star" or similar pattern and operate by pressing the tail end 24 of the blade into and against cardboard material 26 so that the two or more "rays" 25 of the stars 22 penetrate and expand into the cardboard (or similar) material 26, forming an essentially permanent bond. Glue, other adhesives, staple-like devices and the like may also be used as are well known to those of ordinary skill in the art and can be seen in any grocery store stocking rolls of film in cartons.

Figure 7:
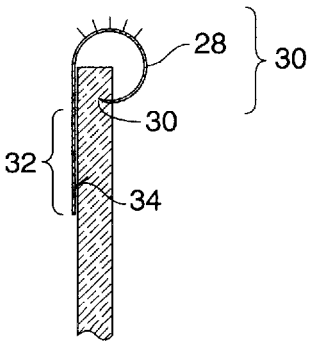
FIG. 7 is a cross sectional diagram of an alternative embodiment of the present invention.
Figure 8:
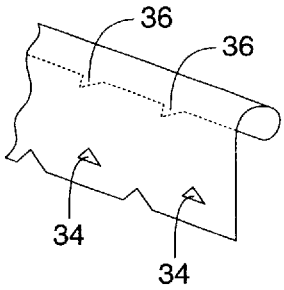
FIG. 8 is a perspective diagram of a cutting blade unmounted to a cardboard sheet, in accordance with the embodiment depicted in FIG. 7.

A presently preferred and alternative embodiment of the "9"-shaped blade of FIG. 1 is shown at FIGS. 7–8. Blade 28 includes a rounded head portion 30 in the shape of a partial tube as shown and a flat tail portion 32. A series of tangs or barbs 34 are punched in the tail portion 32 as shown. Additional barbs 36 are formed along the curved longitudinal end of the rectangular sheet which is bent to form the "9"-shaped blade. When the sheet is thus bent as shown in FIG. 8, it may be slipped over a piece of cardboard, corrugated cardboard, or the like where the tangs or barbs 34, 36 will easily slip over the surface of the cardboard while the blade is being installed, but will resist removal. An advantage presented by this mode of operation is that the blade 28 may be packaged inside a carton of film. When the consumer buys the carton, he or she may then take the blade 28 and slip it over a portion of the carton. The advantage here is that the installation step need not be performed by the manufacturer, and, since it is desired that, in use, the blade 28 protrude above an outside surface of the carton, a higher packing density in shipping boxes and crates can be achieved by not having blade 28 protrude above the outside surface of the carton until actually purchased and in use by the consumer.

Figure 9:
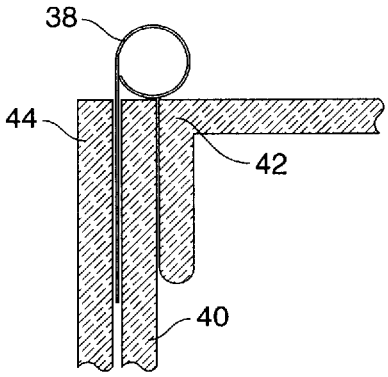
FIG. 9 is a cross sectional diagram of a cutting blade mounted to a cardboard or other type of insert as it might be used to latch the cover of the dispenser closed.

An alternative method of implementing this advantage is shown in FIG. 9. In FIG. 9, blade 38 is attached (in any manner) to a cardboard insert 40 which may be inserted between lid 42 and end wall 44 of a carton such as that shown in FIG. 5. The insert and the blade 38 may preferably be permanently bonded together at the factory in any convenient manner. The insert is inserted into the package in, for example, an inverted position. When the consumer opens the package, he or she inverts the insert 40 so that the blade protrudes from the top of the carton as shown in FIG. 9. In this manner, maximum packing densities are achieved as the shape of the shipped product is a rectangular solid, yet the advantage of a protruding blade is not lost. An additional advantage of this FIG. 9 design is that by making the rounded head portion 30 large enough so that in use it overlaps lid 42, it will then provide a latching function keeping the lid 42 closed as shown in FIG. 9 without any additional latching mechanism being needed.

Figure 10:
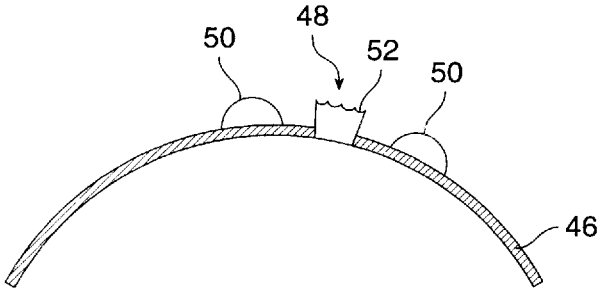
FIG. 10 is a cross sectional diagram showing an alternative embodiment of the present invention in which one or more rows of holes with petals are disposed longitudinally along the cutting blade and surrounded front and back by protective bumps.

Turning now to FIG. 10, an alternative arrangement of the cutting buds of the blade of the present invention is shown. As taught in U.S. Pat. No. 4,340,162 to Heiman et al. and U.S. Pat. No. 4,346,829 to Myers, a plurality of buds disposed through a blade so that petals extend from the holes provides a novel, high performance cutting surface with little propensity to injure. While not presently preferred, if additional protection against accidental scratching by the blade 46 is desired, buds 48 may be surrounded on either side as shown by a line of bumps 50 which permit the foil to be cut by the petals 52 of buds 48 while making it more difficult to accidentally catch the skin of the hand on the petals.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A cutting blade for use with a roll film dispenser, said cutting blade comprising:

a continuous cross-section extending for the length of the blade, said cross section having exactly two ends including a first end and a second end;

said cross-section having a first portion and a second portion;

said first portion including said first end and having a substantially tubular configuration;

said second portion including said second end and being substantially flat;

means for attaching said second portion of said cutting blade to a single planar side of a blade support, wherein said first portion extends beyond a plane defining said single planar side of said blade support and said second portion extends along said plane; and wherein said first end substantially abuts said second portion.

2. A cutting blade according to claim 1 wherein a plurality of buds extends outwardly from said cutting blade, each of said buds comprising at least one sharp petal for engaging roll film material unwrapped from the roll film dispenser and for tearing a desired length of said roll film material off the roll film dispenser, said plural buds being positioned along a first axis perpendicular to the discharge direction of said roll film material from the roll film dispenser.

3. A cutting blade according to claim 2 wherein said plurality of buds extend outwardly from said first portion.

4. A cutting blade according to claim 3 wherein said means for attaching includes a plurality of starburst fasteners, at least some of which are disposed along a second axis perpendicular to the discharge direction of the roll film material from the roll film dispenser.

5. A removable insert for use with a roll film dispenser, said insert comprising:

a first side and a second side, said first side being substantially planar, said second side being substantially planar, and said first side being substantially parallel to said second side;

a cutting blade structure having a continuously shaped cross-section extending substantially along the length of the insert, said cross-section having exactly two ends including a first end and a second end;

said cross-section also having a first portion and a second portion;

said first portion of said cross-section having a substantially tubular configuration and including said first end;

said second portion of said cross section being substantially flat and including said second end;

means for attaching said second portion of said cross section to said first side of the insert, wherein said first portion of said cross section extends beyond a plane defining a surface of said first side and said second portion of said cross section extends along said plane; and wherein said first end substantially abuts said second portion.

6. A removable insert according to claim 5 wherein a plurality of buds extends outwardly from said cutting blade structure, each of said buds comprising at least one sharp petal for engaging roll film material unwrapped from the roll film dispenser and for tearing a desired length of the roll film material off the roll film dispenser, said plural buds being positioned along a first axis perpendicular to the discharge direction of the roll film material from the roll film dispenser.

7. A removable insert according to claim 6 wherein said plurality of buds extend outwardly from said first portion of said cross section.

8. A removable insert according to claim 7 wherein said means for attaching includes a plurality of starburst fasteners, at least some of which are disposed along a second axis perpendicular to the discharge direction of the roll film material from the roll film dispenser.

* * * * *

UNITED STATES PATENT AND TRADEMARK OFFICE

CERTIFICATE OF CORRECTION

PATENT NO. : 5,772,094

DATED : June 30, 1998

INVENTOR(S) : Ian Reed Kaiser, Michael Charles Kaiser, Sean Allen Neiberger

It is certified that error appears in the above-identified patent and that said Letters Patent is hereby corrected as shown below:

On Col. 4, line 58, replace "petals may" with --petals 20 may--.

On Col. 4, line 61, replace "petals." with --petals 20.--.

On Col. 4, line 61, replace "petals which" with --petals 20 which--.

On Col. 4, line 66, replace "petals and" with --petals 20 and--.

On Col. 5, line 2, replace "petals." with --petals 20.--.

On Col. 5, line 54, replace "insert and" with --insert 40 and--.

On Col. 5, line 56, replace "insert is" with --insert 40 is--.

On Col. 5, line 58, replace "blade protrudes" with --blade 38 protrudes--.

On Col. 6, line 13, replace "petals." with --petals 52.--.

On Col. 6, line 25, replace "cross section" with --cross-section--.

Signed and Sealed this

Ninth Day of February, 1999

*Attest:*

*Attesting Officer*

*Acting Commissioner of Patents and Trademarks*